US006382932B2

(12) United States Patent
Kim

(10) Patent No.: US 6,382,932 B2
(45) Date of Patent: May 7, 2002

(54) HERMETIC COMPRESSOR

(75) Inventor: Gui-Gwon Kim, Suwon (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/756,240

(22) Filed: Jan. 9, 2001

(30) Foreign Application Priority Data

Mar. 9, 2000 (KR) ..... 00-11872

(51) Int. Cl.[7] ..... F04B 17/00
(52) U.S. Cl. ..... 417/363
(58) Field of Search ..... 417/363, 312, 417/415, 902, 53; 181/200, 202, 198

(56) References Cited

U.S. PATENT DOCUMENTS 4,251,986 A * 2/1981 Thompson et al. ..... 60/39.32
4,345,882 A * 8/1982 Saito et al. ..... 417/312
4,682,753 A * 7/1987 Clark ..... 248/631
5,145,330 A * 9/1992 Uchiyama ..... 248/635
5,339,652 A * 8/1994 Dreiman ..... 181/403
6,035,963 A * 3/2000 Wollitz ..... 181/198
6,092,997 A * 7/2000 Kimura et al. ..... 417/223
6,276,906 B1 * 8/2001 Noguchi ..... 417/363

* cited by examiner

*Primary Examiner*—Joseph Pelham
*Assistant Examiner*—Vinod Patel
(74) *Attorney, Agent, or Firm*—Robert E. Bushnell, Esq.

(57) ABSTRACT

A hermetic compressor having a noise absorbing member disposed in an enclosed casing for noise reduction is provided. The noise absorbing member substantially in a circular disk shape is attached to an inner surface of an upper side of the upper shell to reduce various machine noises generated during an operation mode of the compressor. The noise absorbing member includes a circular disk, a hole formed at the center portion of the circular disk, and a plurality of extending portions radially and outwardly extending from the circular disk. The noise absorbing member is attached to the upper shell and simultaneously fitted around a crankshaft stopper which supports the hole of the noise absorbing member and adheres onto the upper shell.

17 Claims, 5 Drawing Sheets

HERMETIC COMPRESSOR

CLAIM OF PRIORITY

This application makes reference to, incorporates the same herein, and claims all benefits accruing under 35 U.S.C. § 119 from an application for SEALED COMPRESSOR earlier filed in the Korean Industrial Property Office on the Mar. 19, 2000 and there duly assigned Ser. No. 11872/2000.

BACKGROUND OF THE INVENTION

1. Field of the Invention

The present invention relates to a compressor, and more particularly, to a hermetic compressor having a vibration absorbing member adhering onto an upper shell of the hermetic compressor for damping vibration-induced noise and machine noise generated during an operation of the compressor.

2. Description of the Prior Art

Generally, a compressor, such as a hermetic compressor, employed in a refrigerator, air conditioner, etc. includes an enclosed casing formed by upper and lower shells, and an electronic device section and a compression device section disposed within the enclosed casing to perform respective operations corresponding to each other. When electricity is applied to the electronic device section, a crankshaft press-fitted in a rotor of the electronic device section is rotated, and the rotary motion of the crankshaft is transformed into the reciprocal linear motion of a piston through a connecting rod which connects the crankshaft and the piston of the compression device section. Accordingly, while the piston reciprocally moves within a cylinder of the compression device section, refrigrant is compressed and discharged. During the operation of the compressor, vibration-induced noise, i.e., various machine noises occur. This noise includes noise from a high-speed refrigerant flow, noise generated due to the friction between the cylinder and the piston, and noise generated due to percussion occurring during opening/closing of a valve of the compression device section. In the general compressor, a suction muffler and a discharge muffler are employed to reduce the noise from the fluid flow, while a noise absorbing structure is employed to reduce various machine noises.

The noise absorbing structure for reducing the machine noise is constructed in such a manner that the compression device section itself or a frame supporting the compression device section thereon is supported on a bottom of the enclosed casing by a spring to damp and counteract the vibration of the compression device section, thus to prevent transmission of vibration of the compression device section to the enclosed casing. Such a noise absorbing structure, however, is not sufficient to reduce the noise.

The Korean Patent Publication No. 1998-0037772 discloses a casing for a hermetic compressor having a noise absorbing band. The Korean Patent Publication No. 1998-0037772 includes an annular horizontal noise absorbing band and a vertical noise absorbing band of a certain width and adapted onto horizontal and vertical planes. The Korean Patent Publication No. 1998-0037772 shows the increased stiffness and the variance of a spring constant of the enclosing casing. By the conventional noise reducing structure described in the above references, however, since the annular horizontal and vertical noise absorbing bands have to be adapted along an inner surface of the enclosed casing by a proper joining method such as welding, etc., an assembling process becomes complicated, and the assembling time is lengthened. Accordingly, the productivity of the compressor is lowered.

SUMMARY OF THE INVENTION

It is an object of the present invention to provide a hermetic compressor able to reduce noise generated during an operation of the hermetic compressor.

It is another object to provide a hermetic compressor able to reduce noise in a certain frequency range.

It is yet another object to provide a hermetic compressor able to change a characteristic frequency of vibration of the hermetic compressor.

It is still another object to provide a hermetic compressor able to increase the stiffness of a casing of the hermetic compressor.

It is a further object to provide a hermetic compressor able to reduce an assembling time when a noise absorbing member is assembled into a casing of the hermetic compressor.

These and other objects may be achieved by providing a hermetic compressor having an enclosed casing formed of upper and lower shells, an electronic device section and a compression device section disposed in the enclosed casing for compressing refrigerant, the electronic device section generating a driving force, the compression device section being linearly moved by the a driving force transmitted from the electronic device section, a noise absorbing member substantially in the shape of a circular disk shape disposed at an inner surface of an upper side of the upper shell for reducing machine noise generated during the operation of the compressor.

The noise absorbing member includes a hole formed at a center portion and a plurality of extending portions radially extending from the hole. The noise absorbing member adheres onto the inner surface of the upper shell and simultaneously contacts a crankshaft stopper which supports the hole of the noise absorbing member and is disposed within the hole and attached onto the a control portion of the upper shell.

By inserting the hole of the noise absorbing member around the crankshaft stopper, the noise absorbing member can be easily disposed in the enclosed casing while the crankshaft stopper adheres onto the upper shell. Without a further separate process, such as a separate welding or the like the noise absorbing member is attached to the upper shell and around the crankshaft stopper. Since the assembling time is greatly reduced, the productivity of the compressor is also greatly improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
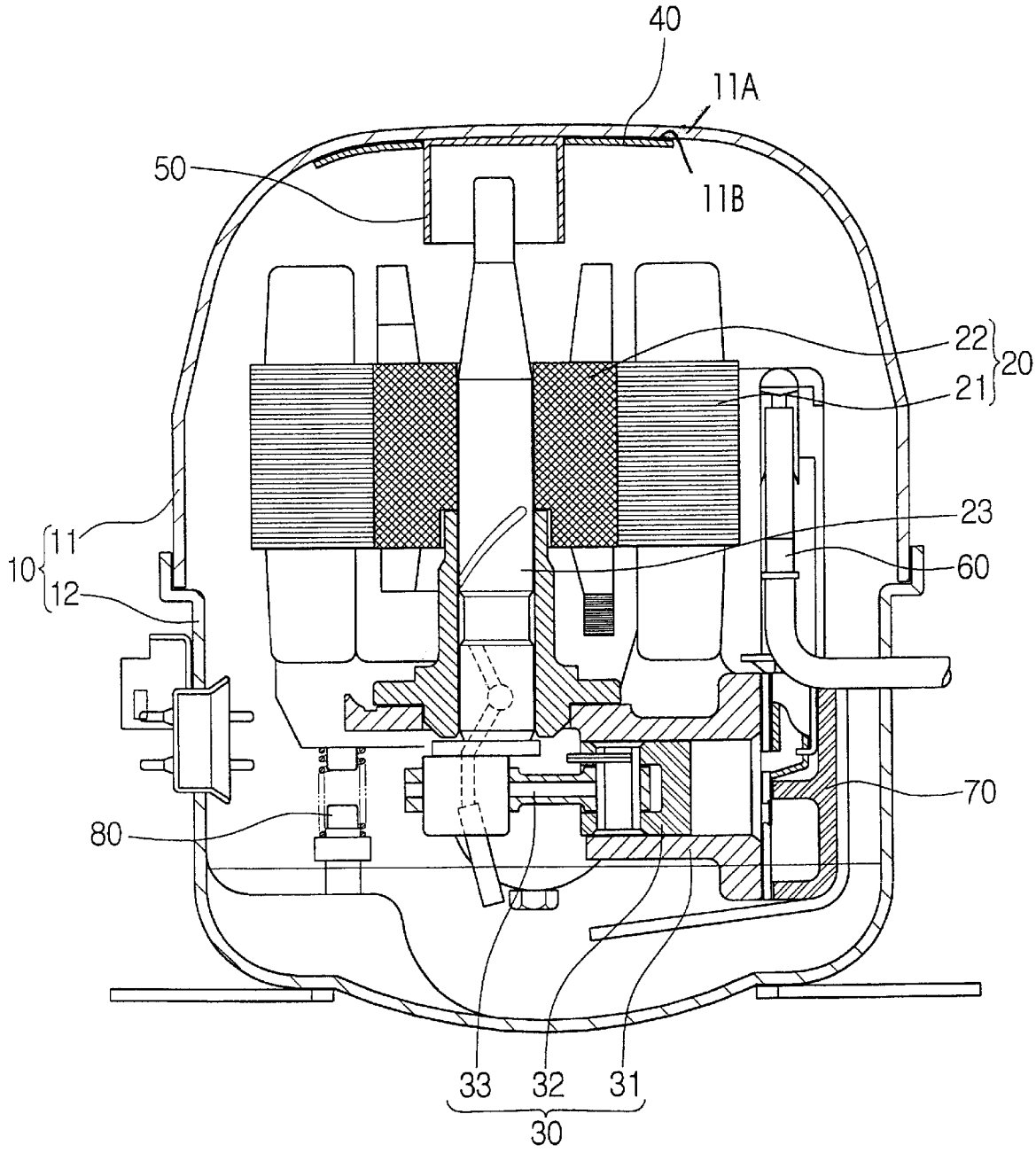
FIG. 1 is a cross-sectional view schematically showing the structure of a hermetic compressor according to the principle of the present invention.

Referring to FIG. 1, a hermetic compressor according to the principle of the present invention includes an enclosed casing 10, an electronic device section 20, a compression device section 30, and a noise absorbing member 40.

Enclosed casing 10 includes a semi-sphere upper and lower shells 11 and 12 which define an enclosed space therebetween by being joined with each other. Electronic device section 20 is disposed within upper shell 11 of the enclosed casing 10 and includes a stator 21, a rotor 22 and a crankshaft 23 press-fitted into rotor 22. Compression device section 30 is disposed within lower shell 12 of enclosed casing 10 and includes a cylinder 31, a piston 32 reciprocally movable within cylinder 31, and a connecting rod 33 disposed between piston 32 and crankshaft 23 to transform the rotary motion of crankshaft 23 into the reciprocal linear motion of piston 32.

Figure 2:
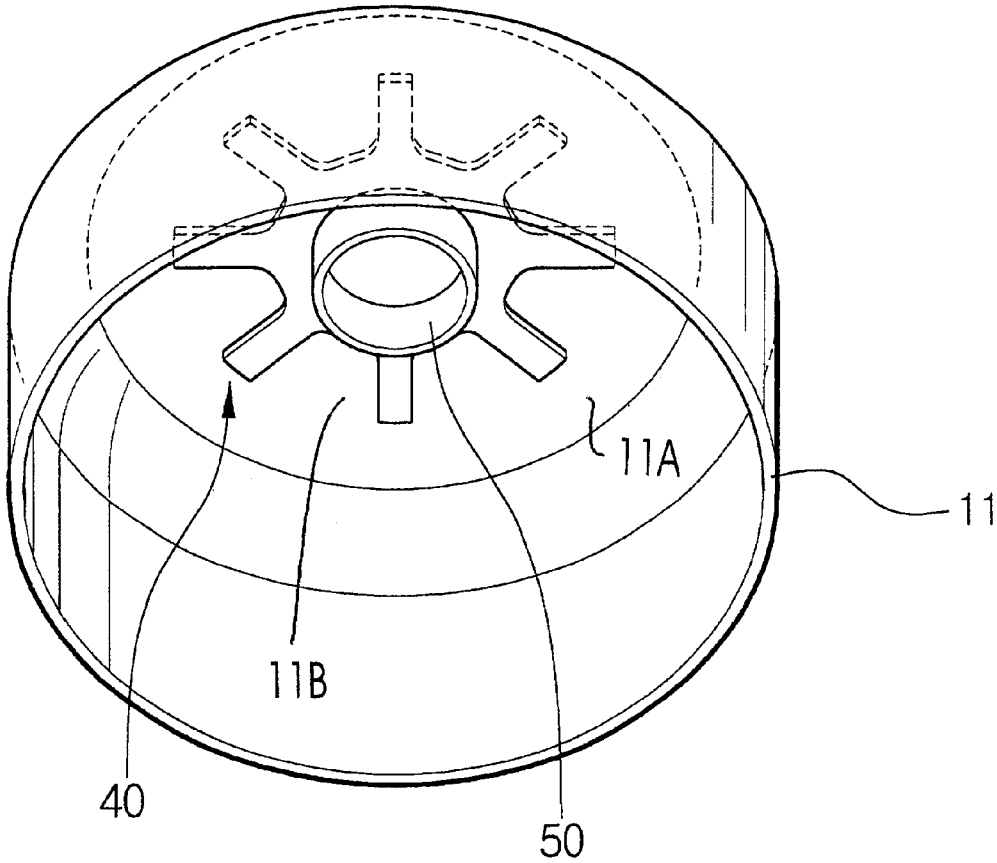
FIG. 2 is a bottom perspective view of an upper shell into which a noise absorbing member is employed.
Figure 3:
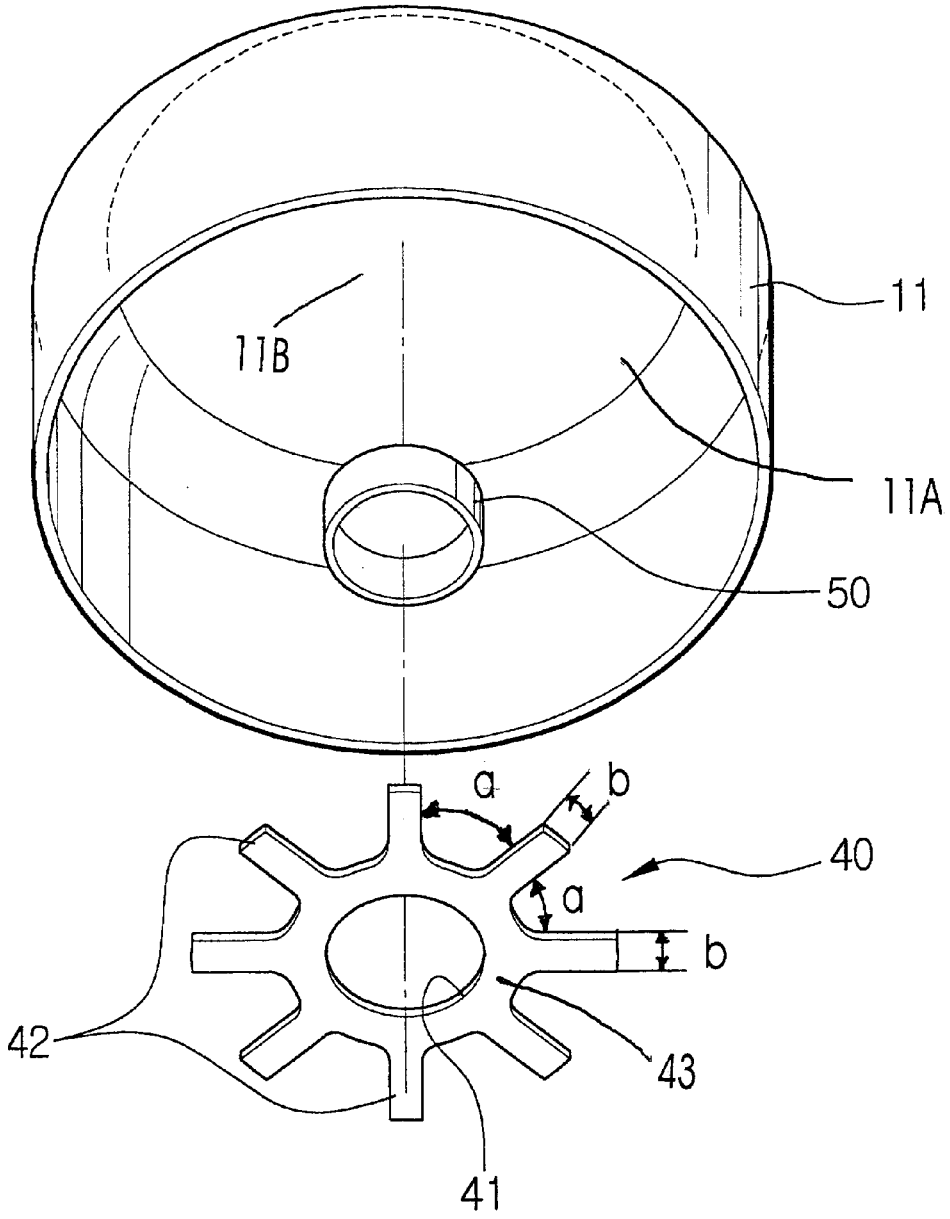
FIG. 3 is an exploded perspective view for showing the noise absorbing member, a crankshaft stopper, and the upper shell.

Noise absorbing member 40 reduces vibration-induced noise, i.e. various machine noises which are generated during the operation of the compressor. As shown in FIG. 2, noise absorbing member 40 adheres onto an inner surface 11B of a top portion 11A of upper shell 11. Noise absorbing member 40 is substantially in a circular disk shape and includes a hole 41 formed at a center of a circular portion 43, and a plurality of extending portions 42 which are formed on the outer circumference of the noise absorbing member 40 by radially and outwardly extending from circular portion 43 at an equal spacing a. A thickness b of each extending portion 42 may be constant or varies. The shape of noise absorbing member 40 having circular portion 43 and extending portions 42 contributes to change stiffness and spring constant of upper shell 11.

Noise absorbing member 40 tightly adheres onto inner surface 11B of upper shell 11, as the crankshaft stopper 50 supported by hole 41 formed at the center of noise absorbing member 40 adheres onto upper shell 11. Here, crankshaft stopper 50 adheres onto the upper shell 11 by spot welding. That is, while adhering onto crankshaft stopper 50, noise absorbing member 40 simultaneously adheres onto upper shell 11 by the welding and accordingly does not require a further separate process for attaching noise absorbing member 40 to upper shell 11.

In the hermetic compressor constructed as above according to the principle of the present invention, when electricity is applied to electronic device section 20, rotor 22 is rotates, and simultaneously, crankshaft 23 coupled to rotor 22 rotates. The rotary movement of crankshaft 23 is transformed into the linear motion of piston 32 through connecting rod 33, and accordingly, the piston 32 suctions, compresses, and discharges the refrigerant while performing reciprocal linear movement in cylinder 31.

At this time, as in the conventional case, the noise from the high-speed fluid flow and the machine noise due to vibration of various components are generated. Here, the noise from the fluid flow may be reduced by suction and discharge mufflers 60 and 70 while the vibration causing the machine noise is firstly damped and counteracted by a noise absorbing structure 80 and then is transmitted to enclosed casing 10. Accordingly, while the machine noise may be reduced in a certain degree, there exists vibration of a large amplitude within a certain frequency range generated at enclosed casing 10. The vibration from enclosed casing 10, however, is secondly reduced by noise absorbing member 40 which adheres to upper shell 11 according to the present invention. More specifically, with noise absorbing member 40 adhering onto a center portion of inner surface 11B of upper shell 11, the stiffness of enclose casing 10 increases, and spring constant of enclose casing 10 varies. Accordingly, the characteristic frequency range of enclosed casing 10 is changed from the resonance frequency into a certain frequency range with the reduced vibration and reduced amplitude, thereby significantly reducing the noise caused by the vibration.

Figure 4A:
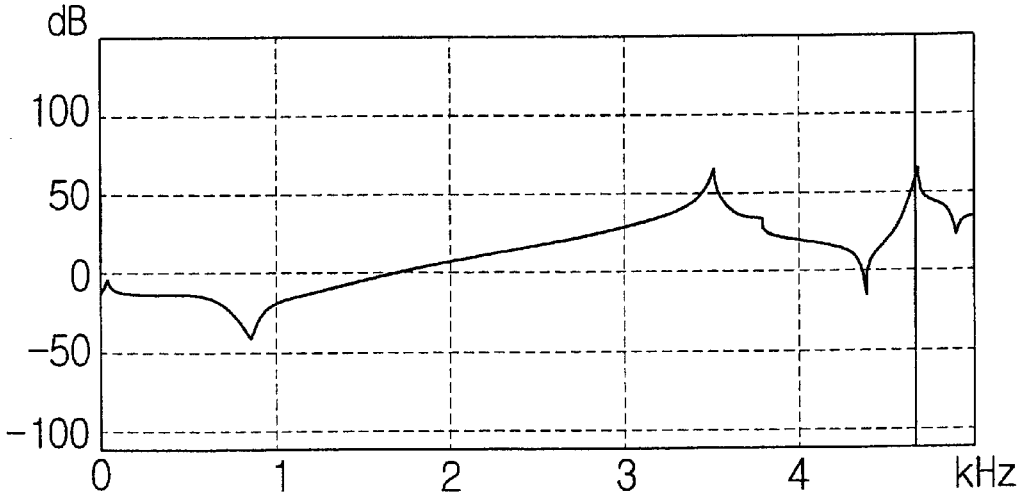
FIGS. 4A and 4B are graphs showing the comparison of the respective frequency amplitudes detected from the upper shell of the prior art and of the present invention into which the noise absorbing member is employed.
Figure 4B:
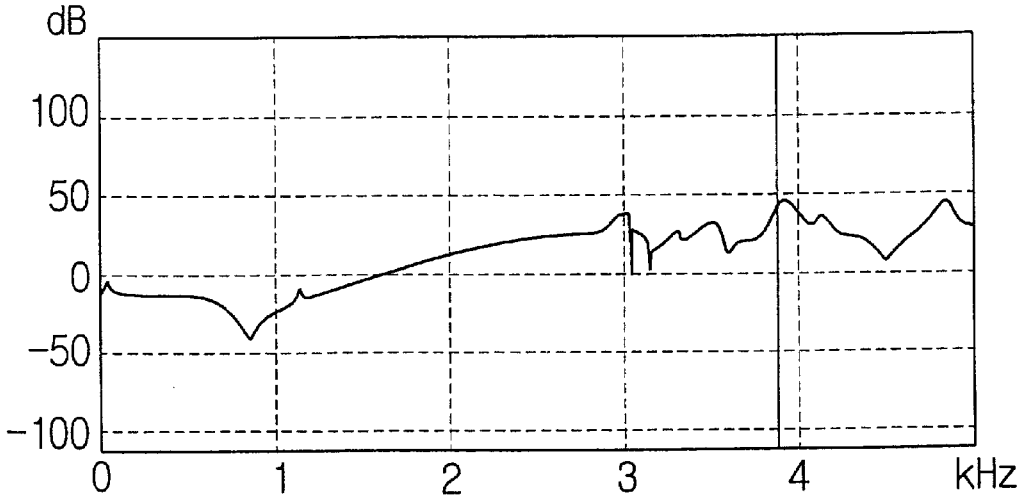

The characteristic frequency of vibration was analyzed at the upper shell 11 onto which noise absorbing member 40 adheres. As shown in FIGS. 4A and 4B, the results show a significant difference between the present invention and the prior art. That is, FIG. 4A shows the noise degree detected from upper shell 11 of the conventional compressor without the noise absorbing member, and FIG. 4B shows the noise degree detected from upper shell 11 of the compressor onto which the noise absorbing member 40 adheres according to the present invention. As shown in FIGS. 4A and 4B, there are large differences of the characteristic frequency of vibrations between both compressors in a certain frequency range. According to the present invention, due to the significant amplitude reduction of vibration in the certain frequency range by the change of the characteristic frequency of vibration of upper shell 11, the noise by the vibration can be reduced.

Figure 5:
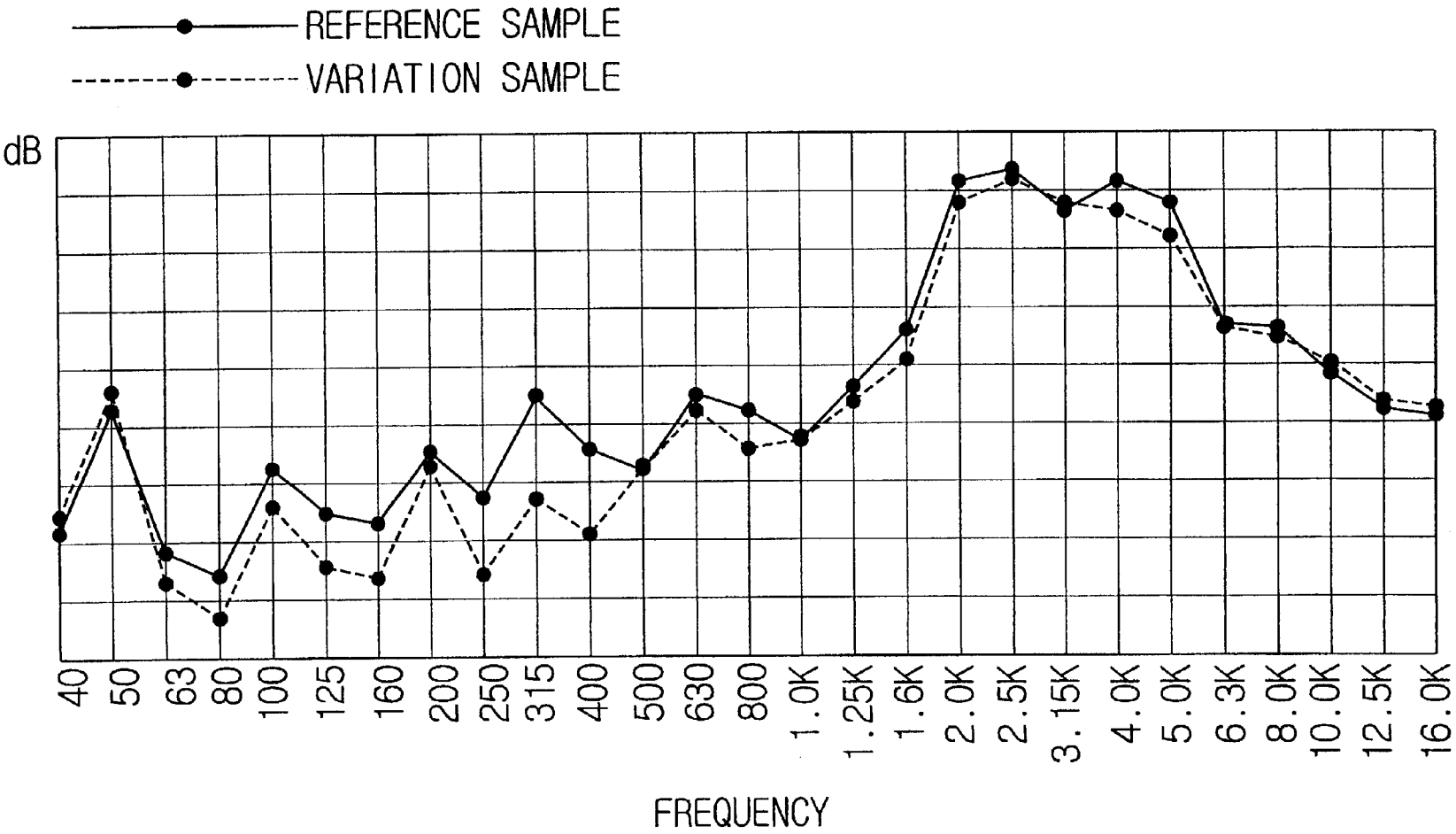
FIG. 5 is a graph for showing the comparison of the noise degree generated from the prior art compressor and from the compressor according to the present invention.

FIG. 5 shows the experiment result, in which a dotted line indicating the noise degree detected from the hermetic compressor according to the present invention is mostly lower than a solid line indicating the noise degree detected from the conventional hermetic compressor. In the certain frequency range, in particular, i.e., in the frequency range of 80–800 Hz, the amplitude is reduced and the operation of the refrigerator or the air conditioner having a compressor can be performed with very low noise.

As described above, in the hermetic compressor according to the present invention, the noise absorbing member substantially in a circular disk shape adheres more easily onto upper shell 11 for reducing various machine noises generated during the operation of the compressor. Further, since the noise absorbing member can be simply adhered onto the upper shell 11 simultaneously when adhering the crankshaft stopper of the compressor to the upper shell 11, the noise absorbing member adhering time can be significantly reduced, and accordingly, the productivity of the compressor increases.

As stated above, a preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A hermetic compressor, comprising:

an enclosed casing formed of upper and lower shells, having an electronic device section and a compression device section disposed in said enclosed casing to compress refrigerant supplied into said compression device section and discharging the compressed refrigerant out of said enclosed casing; and a noise absorbing member substantially in a shape of a circular disk disposed at an inner surface of an upper side of said upper shell for reducing noise generated during said operation of the compressor.

2. The hermetic compressor of claim 1, said noise absorbing member including a hole formed at a center portion of said circular disk.

3. The hermetic compressor of claim 2, further comprising a crankshaft stopper having a shape of a hollow cylinder, having one end adhering onto said inner surface of said upper side of said upper shell.

4. The hermetic compressor of claim 3, said hole of said noise absorbing member fitted around said crankshaft stopper while adhering onto said inner surface of said upper side.

5. The hermetic compressor of claim 3, further comprising:

said crankshaft stopper having an open end opposite to said one end; and said electronic device section having a crankshaft transmitting a driving force from said electronic device section to said compression device section, one end of said crankshaft inserted inside said crankshaft stopper through said open end of said crankshaft stopper.

6. The hermetic compressor of claim 2, said noise absorbing member including a plurality of extension portions radially extending from said circular disk.

7. The hermetic compressor of claim 6, said extension portions spared apart from each other at a predetermined interval.

8. The hermetic compressor of claim 6, said extension portions having a predetermined thickness.

9. The hermetic compressor of claim 8, when said thickness varies along a radial direction.

10. A hermetic compressor, comprising:

an enclosed casing formed of upper casing and lower shells, having an electronic device section generating a driving force, a compression device section compressing refrigerant supplied into said compression device section through said enclosed casing and discharging the refrigerant out of said enclosed casing in dependence upon said driving force during an operation mode, and a crankshaft coupling said electronic device to said compression device; and a noise absorbing member in a shape of a circular disk disposed on an inner surface of an upper side of said upper shell for reducing noise generated during said operation mode.

11. The hermetic compressor of claim 10, said noise absorbing member having a hole formed at a center portion of said circular disk.

12. The hermetic compressor of claim 10, said noise absorbing member having a plurality of extension portions radially extending from said circular disk.

13. The hermetic compressor claim 12, said extension portions spaced apart from each other at a predetermined interval.

14. The hermetic compressor of claim 12 said extension portions having a predetermined thickness.

15. The hermetic compressor of claim 12 said extension portions having a thickness varying along a radial direction.

16. The hermetic compressor of claim 10, further comprising:

a crankshaft cylinder, having one end adhering onto said inner surface of said upper side, having an open end opposite to said one end; and one end of said crankshaft inserted into said crankshaft stopper through said open end of said crankshaft stopper.

17. The hermetic compressor of claim 16, said noise absorbing member having a hole formed at a center portion of said circular disk, said hole fitted around said hollow cylinder of said crankshaft stopper.

* * * * *